US011052424B1

(12) United States Patent
Weisbarth et al.

(10) Patent No.: US 11,052,424 B1
(45) Date of Patent: Jul. 6, 2021

(54) PAINT TRENCHER

(71) Applicants: Lynette Weisbarth, Bremerton, WA (US); Randal Weisbarth, Bremerton, WA (US)

(72) Inventors: Lynette Weisbarth, Bremerton, WA (US); Randal Weisbarth, Bremerton, WA (US)

( * ) Notice: Subject to any disclaimer, the term of this patent is extended or adjusted under 35 U.S.C. 154(b) by 0 days.

(21) Appl. No.: 17/105,080

(22) Filed: Nov. 25, 2020

Related U.S. Application Data

(63) Continuation-in-part of application No. 16/733,078, filed on Jan. 2, 2020, now Pat. No. 10,875,141.

(51) Int. Cl.

| | |
|---|---|
| ***B24B 23/00*** | (2006.01) |
| ***B24B 7/18*** | (2006.01) |
| ***B24D 15/02*** | (2006.01) |
| ***B24D 15/04*** | (2006.01) |
| ***B05D 3/12*** | (2006.01) |

(52) U.S. Cl.
CPC ..... *B05D 3/12* (2013.01); *B24B 7/18* (2013.01); *B24B 23/00* (2013.01); *B24D 15/02* (2013.01); *B24D 15/04* (2013.01)

(58) Field of Classification Search
CPC ..... B24B 7/18; B24B 7/182; B24B 23/00; B24D 15/02; B24D 15/023; B24D 15/04; B05D 3/12
USPC ..... 451/344, 354, 494, 523, 524, 525, 552, 451/557, 558
See application file for complete search history.

(56) References Cited

U.S. PATENT DOCUMENTS

| | | | | |
|---|---|---|---|---|
| 2,429,550 | A * | 10/1947 | Hein | B24D 15/023 451/516 |
| 2,569,253 | A * | 9/1951 | Opland | B24D 15/023 451/523 |
| 5,885,145 | A * | 3/1999 | O'Mara | A46B 13/008 15/22.2 |
| 6,213,861 | B1 * | 4/2001 | Gunn | B27G 17/025 451/523 |
| 7,264,541 | B1 * | 9/2007 | Ray | B24D 15/023 451/344 |
| 7,485,031 | B1 * | 2/2009 | Stubbs | B24B 7/184 451/523 |
| 9,511,480 | B1 * | 12/2016 | Ingram, Sr. | B24D 15/04 |
| 2001/0001757 | A1 * | 5/2001 | Gunn | B27G 17/025 451/557 |
| 2006/0199484 | A1 * | 9/2006 | Brown | B24D 15/04 451/523 |
| 2017/0297051 | A1 * | 10/2017 | Cameron | B05C 17/0245 |
| 2020/0094378 | A1 * | 3/2020 | Sigler | B24D 15/023 |

* cited by examiner

*Primary Examiner* — Eileen P Morgan

(57) ABSTRACT

A paint trencher includes a main body, an abrasive body, and a handle. The main body includes a top panel, a bottom panel, and a support. The abrasive body, preferably a beveled-elongated body, is adjacently mounted to the support in order to cut into the wall. The handle is mounted to the top panel so that applied pressure of the main body can be transferred into the abrasive body thus cutting a trench into the wall. A felt pad is perimetrically attached around the bottom panel so that the surrounding wall area of the trench can be protected from unnecessary scratches.

3 Claims, 8 Drawing Sheets

PAINT TRENCHER

The current application is a continuation-in-part (CIP) application of the U.S. non-provisional application Ser. No. 16/733,078 filed on Jan. 2, 2020.

FIELD OF THE INVENTION

The present invention relates generally to paint surface preparation tools. More specifically, the present invention is an apparatus that prepares a wall for crisp, clean paint lines by sanding off obstacles such as texture and paint build-up while at the same time creating a trench that acts as a guide for the tip of a paintbrush and a well for paint to flow into.

BACKGROUND OF THE INVENTION

When it comes to painting walls, one of the hardest and most time-consuming parts is painting around the vertical wall corners and ceiling corners. In order to get razor-sharp edge lines, painters normally use paint edger tools or painter's tape. Paint edger tools are typically used for wall painting above baseboards, below crown molding, around window and door trim, and at the juncture between two walls, such as for accent walls. Sometimes paint edger tools can cause problems for painters due to handling difficulties and inexperience. Additionally, if there is any texture on the wall, paint edger tools do not work to their full capacity. Paint edger tools work best on smooth surfaces. Painter's tape, also known as masking tape, is a type of pressure-sensitive tape made of a thin and easy-to-tear paper, and an easily released pressure-sensitive adhesive. The adhesive is the key element to its usefulness, as it allows the painter's tape to be easily removed without leaving residue or damaging the surface to which it is applied. However, applying painter's tape can be time consuming and expensive. More importantly, painter's tape does not work effectively on textured walls because the texture creates gaps, compromising the seal of the tape to the wall, which causes the paint to "bleed" through and give a sloppy appearance.

It is therefore an objective of the present invention to provide an apparatus that sands off an approximate ⅛" line of the existing texture on the portion of the wall closest to the ceiling so as to provide a smooth surface for the bristles of a paint brush to run across without any obstruction. In addition to sanding off the texture, the abrasive body has a slight angle and protrusion toward the distal edge which, as pressure is being applied to do the sanding, causes a "trench" that the paint can flow into when running the brush along the cutting line. Also, by sanding the texture off of inside corners, paint edging tools can be used to their fullest capacity. As a result of the trench, the painters can get sharp paint lines without any guesswork.

DETAIL DESCRIPTIONS OF THE INVENTION

All illustrations of the drawings are for the purpose of describing selected versions of the present invention and are not intended to limit the scope of the present invention.

The present invention relates generally to paint surface preparation tools. More specifically, the present invention is an apparatus that prepares a wall for crisp, clean paint lines by sanding off obstacles such as texture and paint build-up while at the same time creating a trench that acts as a guide for the tip of a paintbrush and a well for paint to flow into. More specifically, the present invention is a paint trencher that cuts a clean trench into celling corners or vertical corners such as above baseboard, below crown molding, around window and door trim, and at the juncture between two walls or wall and ceiling. Once the present invention is utilized to cut the trench, a paint brush can be followed along the trench in order to get clean and crisp paint lines as the tip of the paint brush can be placed within the trench.

Figure 1:
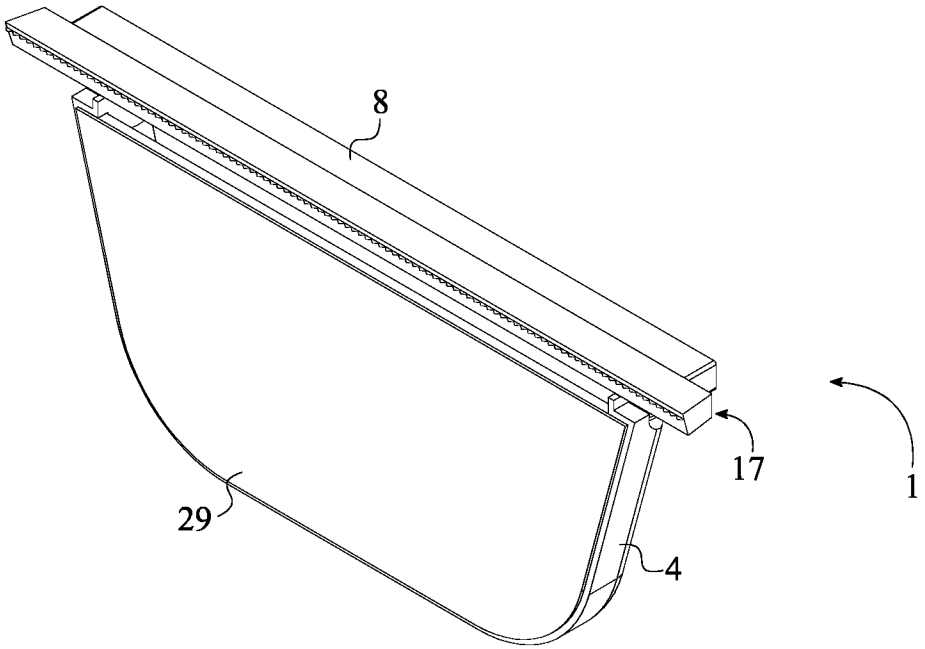
FIG. 1 is a perspective view of the present invention, wherein the cutting edge is positioned within the sanding surface.
Figure 2:
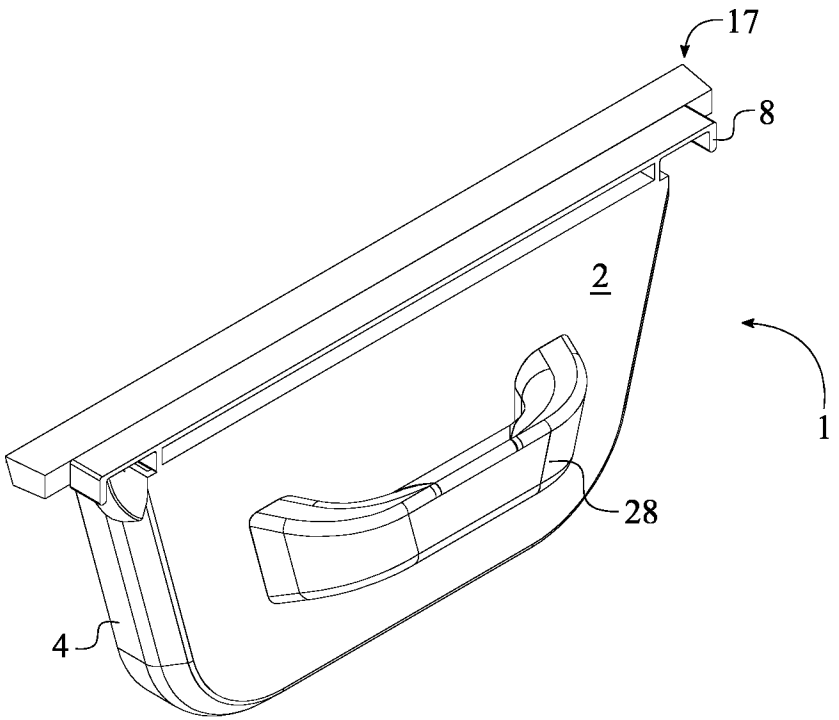
FIG. 2 is another perspective view of the present invention.
Figure 3:
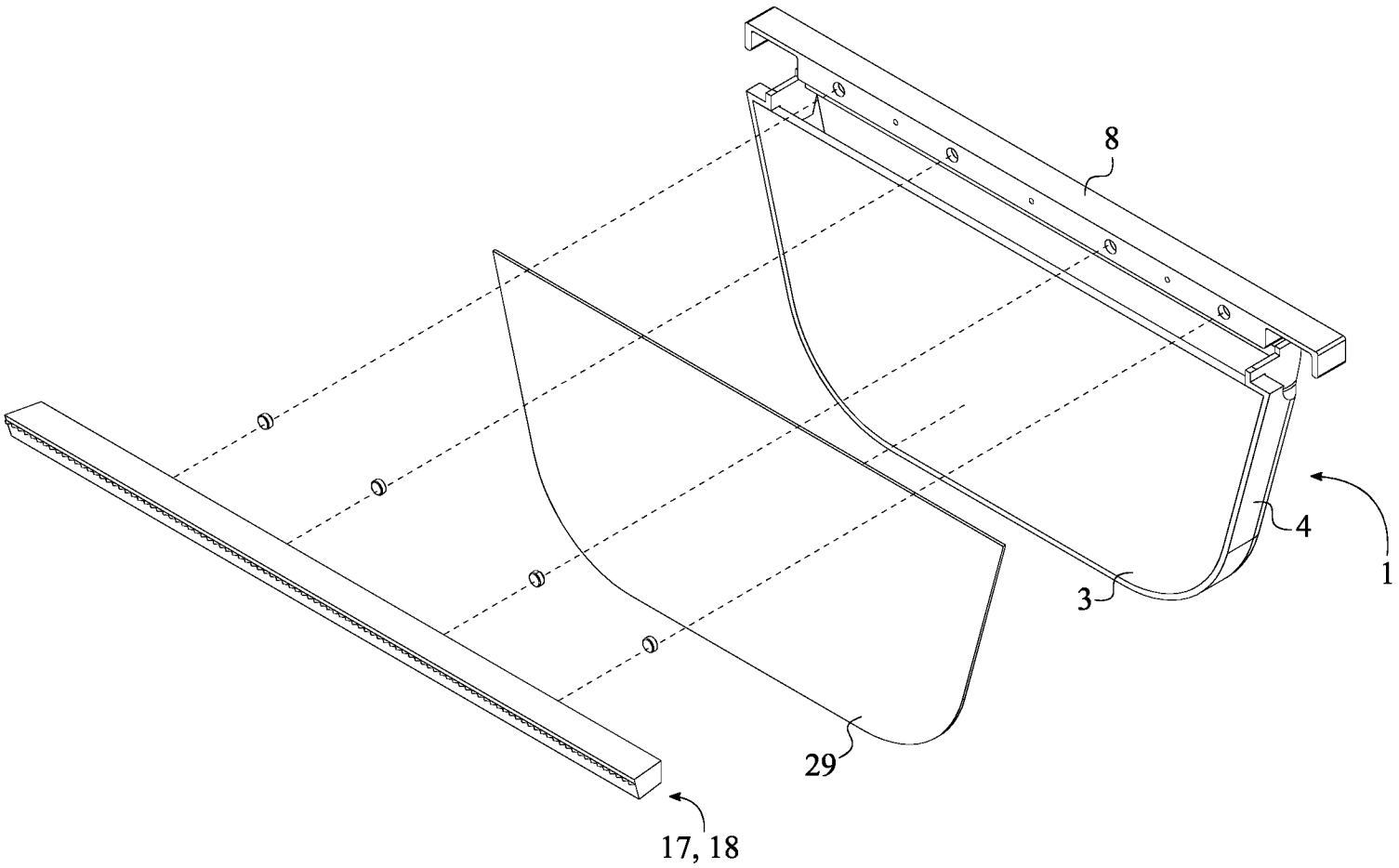
FIG. 3 is an exploded view of the present invention.

The present invention comprises a main body 1, an abrasive body 17, and a handle 28 as shown in FIG. 1-3. The main body 1 comprises a top panel 2, a bottom panel 3, and a lateral wall 4 thus enabling the rest of the components to be referenced and connected. In reference to the general configuration, the abrasive body 17 is adjacently mounted to the support 8 and functions as the cutting apparatus so that the trench can be cut into the wall. Resultantly, the abrasive body 17 is oriented towards the bottom panel 3. The handle 28 that provides surface area to grip and control the main body 1 is mounted to the top panel 2 and positioned opposite of the abrasive body 17. Due to the opposite positioning of the handle 28 and the abrasive body 17, when a user applies pressure to the present invention, the handle 28 can transfer the applied pressure into the abrasive body 17 via the main body 1 thus cutting the trench into the wall.

The main body 1 functions as a base structure within the present invention as the rest of components are functionally positioned around the main body 1. Additionally, the main body 1 also rests upon a first wall surface so that the present invention can glide along the first wall surface. In reference to FIG. 1-3, the top panel 2 and the bottom panel 3 are oppositely connected to the lateral wall 4 so that the general shape of the main body 1 can be delineated. The support 8 is an elongated structure and laterally connected along a front section 5 of the lateral wall 4 thus providing the necessary surface area to mount the abrasive body 17.

In reference to FIG. 3, the present invention further comprises a first felt pad 29. More specifically, the first felt pad 29 is perimetrically attached around the bottom panel 3 and oriented opposite of the top panel 2. The first felt pad 29 provides a smooth surface area for the main body 1 so that the first wall surface does not get damage during the operation of the present invention.

The handle 28 is configured into an ergonomic grip so that the handle 28 can be comfortable gripped to control the main body 1 as shown in FIG. 2. In the preferred embodiment of the present invention, the handle 28 is a U-shaped body and mounted onto the top panel 2. Furthermore, the handle 28 and the top panel 2 provide a fixed connection in such a way that any directional movements of the handle 28 directly translates into the main body 1. In some embodiment of the present invention, the handle 28 can also be an elongated shaft/pole and pivotably mounted onto the top panel 2. Due to the pivotable connection, the handle 28 can be utilized to reach area such as high ceilings and narrow corners while maintaining the functionality of the abrasive body 17.

Figure 4:
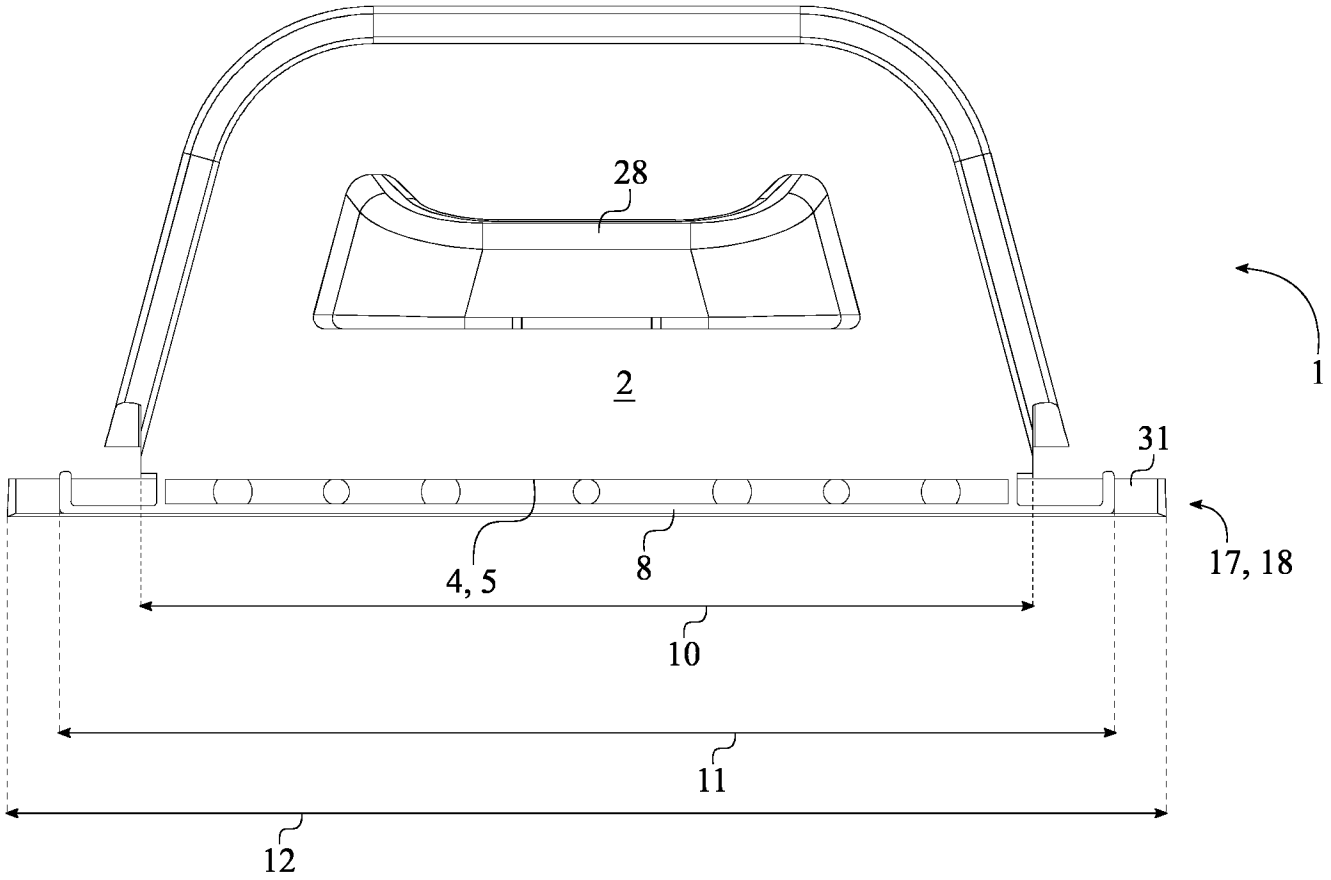
FIG. 4 is a top view of the present invention, showing the length differences of the front section, support, and the abrasive body.
Figure 5:
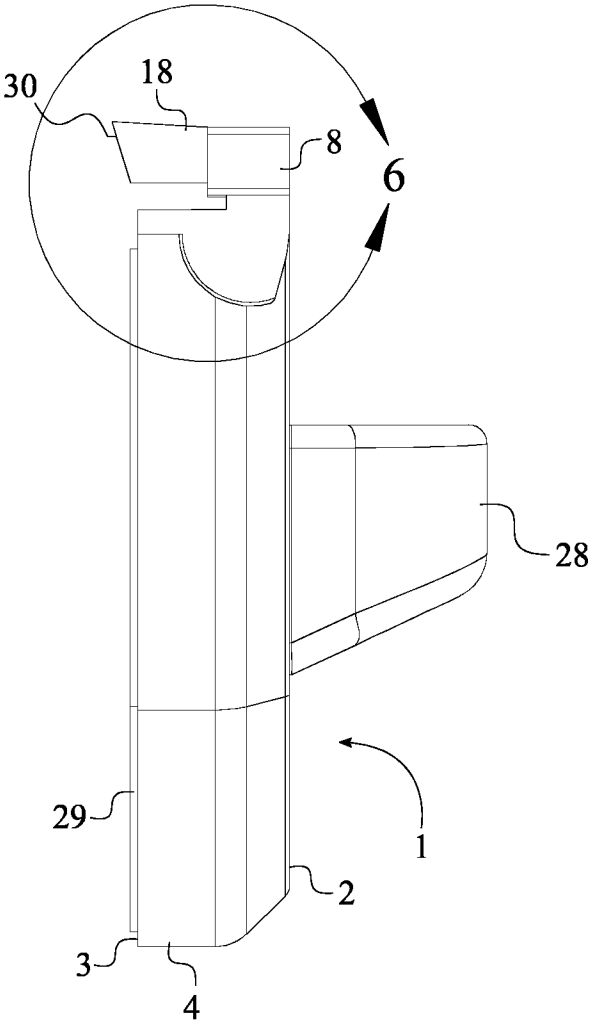
FIG. 5 is a side view of the present invention.
Figure 6:
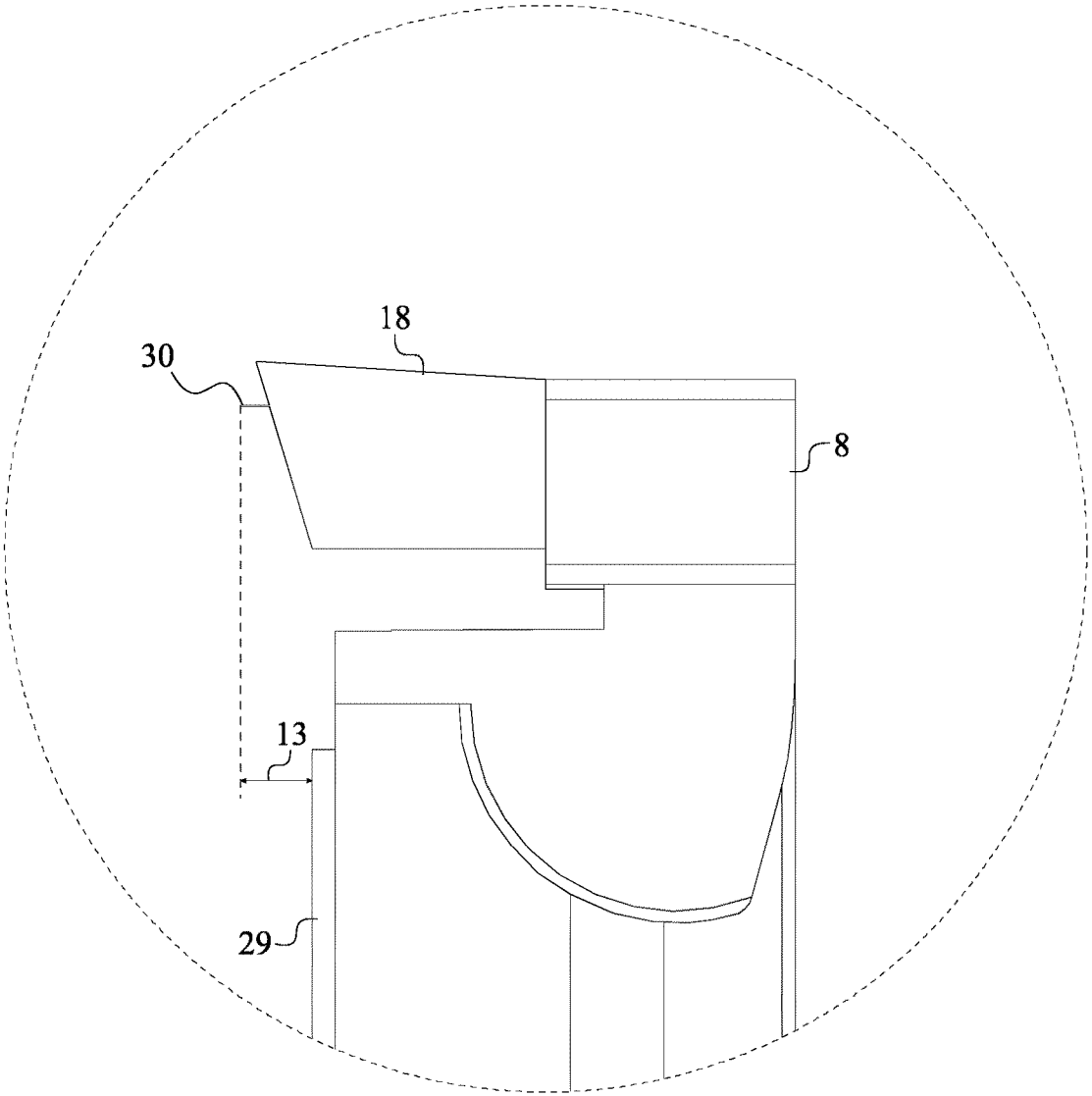
FIG. 6 is a detailed view of the present invention around the support and the abrasive body.

The abrasive body 17 comprises a cutting edge 30 and a mounting surface 31 as shown in FIG. 4-5. More specifically, the cutting edge 30 and the mounting surface 31 are oppositely positioned of each other about the abrasive body 17 for the optimal functionality of the present invention. The mounting surface 31 is adjacently positioned to the support 8 so that the abrasive body 17 can be pressed against the support 8. The cutting edge 30 is oriented away from the support so that the cutting edge 30 can penetrate into the drywall. In order to determine the sufficient depth of the trench, a distance 13 between the cutting edge 30 and the felt pad 29 ranges from 0.01 inch to 0.25 inch as shown in FIG. 6. Preferably, a plurality of magnets is embedded within the support 8 so that the beveled-elongated body 18 can be magnetically attached to the support 8 through the plurality of magnets. When the main body 1 is moved along the first wall surface, the beveled-elongated body 18 slides along and cuts into the first wall surface thus creating the trench. Furthermore, a plurality of structural pins is perpendicularly connected onto the mounting surface 31 so that the plurality of structural pins can be inserted into a plurality of matching holes of the support 8. Resultantly, the plurality of structural pins is able to prevent any lateral movement of the abrasive body 17 that can occur during the usage of the present invention.

In reference to FIG. 4, a length 11 of the support 8 is larger than a length 10 of the front section 5 so that the support 8 can extend pass the main body 1. A length 12 of the abrasive body 17 is larger than the length 11 of the support 8 thus resulting the abrasive body 17 to reach the side wall that runs perpendicular or angular to the first wall. As a result, the abrasive body 17 is able to fully cut the trench on the first wall from one side wall to another side wall.

Figure 7:
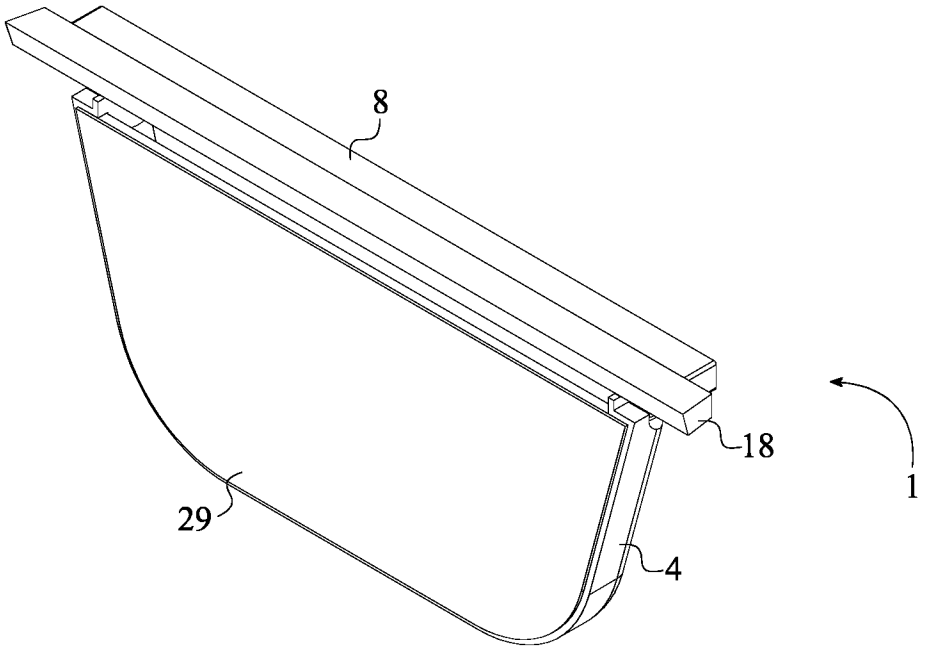
FIG. 7 is a perspective view of the present invention, wherein the cutting edge is terminally positioned to the sanding surface.

The abrasive body 17 is a beveled-elongated body 18 as shown in FIG. 5-7. The beveled-elongated body 18 resembles a configuration of a chisel-end so that the cutting edge 30 of the abrasive body 17 is able to cut into the first wall surface. More specifically, the beveled-elongated body 18 is oriented toward the bottom panel 3 and extended along the support 8. A sanding surface of the beveled-elongated body 18 that is positioned opposite to the mounting surface 31 and adjacent to the cutting edge 30 can manufactured with different coarse grit numbers to accommodate different textures of different drywalls. The cutting edge 30 is delineated at the meeting point of a top edge of the sanding surface and a top surface of the beveled-elongated body 18. In other words, the cutting edge 30 is terminally positioned to the sanding surface of the beveled-elongated body 18 as the sanding surface is angularly positioned to the mounting surface 31. As a result, the beveled-elongated body 18 is able to face toward the first wall surface when the present invention is utilized. Then, the cutting edge 30 is able to cut into the drywall and create the trench while the sanding surface is able to clean up the drywall surface below the trench. The beveled-elongated body 18 is removably mounted along the support 8 so that the user can easily replace any worn out beveled-elongated body with a newer beveled-elongated body.

In some embodiment of the beveled-elongated body 18, the sanding surface of the beveled-elongated body 18 that is positioned around to the cutting edge 30 as shown in FIG. 5-6. Similar to the preferred beveled-elongated body 18, the sanding surface is manufactured with different coarse grit numbers to accommodate different textures of different drywalls. The cutting edge 30 is delineated within the top edge of the sanding surface and a bottom edge of the sanding surface. In other words, the cutting edge 30 is positioned offset from the top end of the sanding surface of the beveled-elongated body 18 as the sanding surface is angularly positioned to the mounting surface 31. More specifically, the beveled-elongated body 18 is oriented toward the bottom panel 3 and extended along the support 8. As a result, the beveled-elongated body 18 is able to face toward the first wall surface when the present invention is utilized. Then, the cutting edge 30 is able to cut into the drywall and create the trench while the sanding surface is able to clean up the surrounding drywall surface above and below the trench. The beveled-elongated body 18 is removably mounted along the support 8 so that the user can easily replace any worn out beveled-elongated body with a newer beveled-elongated body.

Preferably, the cutting edge 30 of the present invention a set of teeth that extends along the beveled-elongated body 18. However, the cutting edge 30 is not limited to the set of teeth and can be any other type of shape features that can easily cut into the drywall to create the trench.

Figure 8:
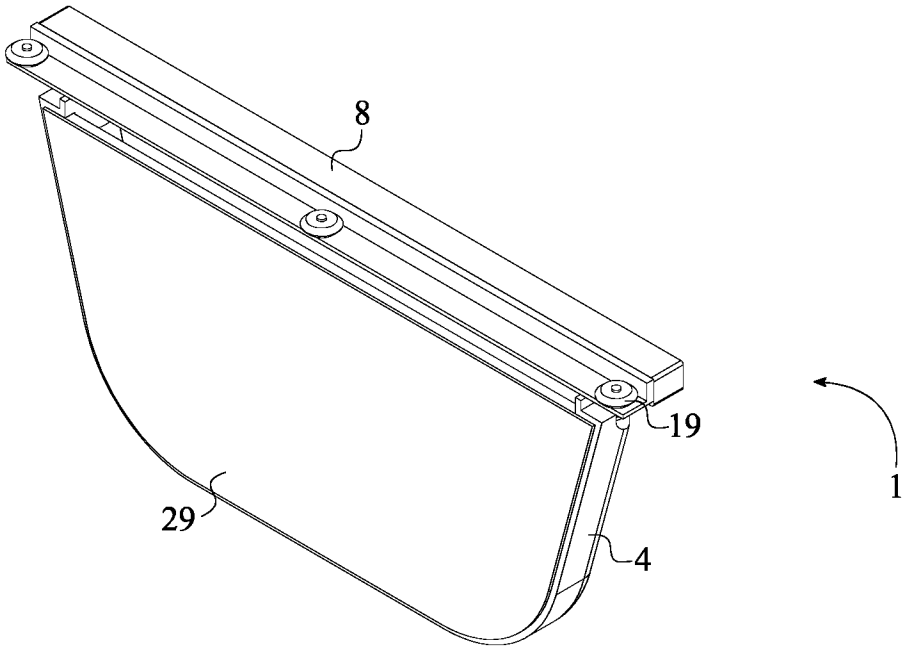
FIG. 8 is a perspective view of the present invention, showing the abrasive body is the at least one beveled-wheel assembly.

In some embodiment of the present invention, the abrasive body 17 can be at least one beveled-wheel assembly 19 as shown in FIG. 8. The beveled-wheel assembly 19 is oriented toward the bottom panel 3 and removably mounted along the support 8. More specifically, the beveled-wheel assembly 19 comprises a connector and a beveled wheel. The connector is removably mounted to the support 8 as the beveled wheel is rotatably connected to the support 8. As a result, when the main body 1 is moved along the first wall surface, the beveled wheel rotates along and cuts into the first wall surface thus creating the trench. In some embodiment of the present invention, the abrasive body 17 can also be a sanding block that cleans up the first wall surface. As a result, when the main body 1 is moved along the first wall surface, the abrasive body 17 moves and cleans along the first wall surface without creating the trench.

Although the invention has been explained in relation to its preferred embodiment, it is to be understood that many other possible modifications and variations can be made without departing from the spirit and scope of the invention as hereinafter claimed.

What is claimed is:

1. A paint trencher comprising:

a main body;

a felt pad;

an abrasive body;

a handle;

the main body comprising a lateral wall, a first planar panel, a second planar panel having a same shape as first panel and positioned opposite the first panel, and an elongated support;

the lateral wall extends around the entirety of the first and second panels for connecting the first panel to the second panel along entire periphery of the first and second panels;

the elongated support being connected to the lateral wall along a linear edge of a first end of the panels;

the felt pad being attached to a planar outer surface of the second panel;

the second panel being positioned in between the first panel and the felt pad;

the abrasive body being removably mounted to the elongated support;

the abrasive body being elongated and extending along the support at the first end of the panels;

the abrasive body comprising a cutting element, a bevel surface and a mounting surface;

the bevel surface and the mounting surface being oppositely positioned of each other about the abrasive body;

the mounting surface being removably mounted to the support;

the mounting surface being positioned in between the support and the bevel surface;

the cutting element being connected to the bevel surface; and the handle being mounted to the first panel.

2. The paint trencher as claimed in claim 1, wherein a length of the support is larger than a length of the front section.

3. The paint trencher as claimed in claim 1, wherein a length of the abrasive body is larger than a length of the support.

* * * * *